US009328638B2

(12) United States Patent
Maekawa et al.

(10) Patent No.: US 9,328,638 B2
(45) Date of Patent: May 3, 2016

(54) OUTBOARD MOTOR

(71) Applicant: YAMAHA HATSUDOKI KABUSHIKI KAISHA, Iwata-shi, Shizuoka (JP)

(72) Inventors: Shinya Maekawa, Shizuoka (JP); Kouichi Isozaki, Shizuoka (JP); Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/531,026

(22) Filed: Nov. 3, 2014

(65) Prior Publication Data

US 2015/0133008 A1 May 14, 2015

(30) Foreign Application Priority Data

Nov. 8, 2013 (JP) ..... 2013-232395

(51) Int. Cl.

| | |
|---|---|
| ***F01M 13/04*** | (2006.01) |
| ***F01M 13/00*** | (2006.01) |
| *B63H 20/24* | (2006.01) |
| *F01M 11/02* | (2006.01) |
| *F02M 35/10* | (2006.01) |
| *F02M 35/16* | (2006.01) |

(52) U.S. Cl.

CPC ..... *F01M 13/04* (2013.01); *F01M 13/00* (2013.01); *B63H 20/24* (2013.01); *F01M 2011/023* (2013.01); *F02M 35/10222* (2013.01); *F02M 35/167* (2013.01)

(58) Field of Classification Search

CPC ..... F02B 75/00; F02B 75/20; F02B 61/045; F02B 33/00; F01M 13/00; F01M 1/06; B63H 20/00; B63H 20/24; B63H 21/38; B63H 21/10

USPC ..... 440/88 L, 88 R; 123/195 P

See application file for complete search history.

(56) References Cited

U.S. PATENT DOCUMENTS

| | | | | |
|---|---|---|---|---|
| 4,656,991 A * | 4/1987 | Fukuo | ..... | F01M 13/00 123/572 |
| 6,062,928 A | 5/2000 | Watanabe et al. | | |
| 6,427,658 B1 | 8/2002 | Toyama et al. | | |

FOREIGN PATENT DOCUMENTS

| | | | | |
|---|---|---|---|---|
| JP | 10184337 A * | 7/1998 | ..... | F01M 13/00 |
| JP | 11-062545 A | 3/1999 | | |
| JP | 2000-320399 A | 11/2000 | | |

* cited by examiner

*Primary Examiner* — Lars O Olson

(74) *Attorney, Agent, or Firm* — Keating and Bennett, LLP

(57) ABSTRACT

An outboard motor includes an engine including a crankshaft that is rotatable about a rotation axis extending in an up-down direction, and a crank chamber that houses the crankshaft. The outboard motor includes an oil pan disposed under the engine to retain lubricating oil to be supplied to at least the crank chamber. The outboard motor includes an oil recovery passage and a first blowby gas passage separate from the oil recovery passage. The oil recovery passage extends downward from the crank chamber to the oil pan and is configured to lead lubricating oil inside the crank chamber to the inside of the oil pan. The first blowby gas passage extends downward from the crank chamber to the oil pan and is configured to lead a blowby gas inside the crank chamber to the inside of the oil pan.

14 Claims, 7 Drawing Sheets

OUTBOARD MOTOR

BACKGROUND OF THE INVENTION

1. Field of the Invention

The present invention relates to an outboard motor.

2. Description of the Related Art

A known outboard motor mixes a blowby gas, which has leaked out of a combustion chamber of an engine into a crank chamber, with intake air to cause recombustion. An outboard motor according to a related art has been described in, for example, Japanese Patent Application Publication No. 11-62545. The outboard motor includes a blowby gas passage that horizontally extends from a crank chamber up to a cam chamber through a side portion of a cylinder defining portion of a cylinder body and a side portion of a cylinder head.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

If a blowby gas is caused to flow through an oil recovery passage to recover lubricating oil, the flow of lubricating oil is disrupted by the blowby gas. Therefore, the occurrence of problems is expected such that the lubricating oil is agitated and the temperature of the lubricating oil rises, and the engine output drops due to an increase in flow-through resistance of the lubricating oil.

On the other hand, in the outboard motor according to the related art, it is necessary to increase the thickness of a component that is lateral to cylinders of the side portion of the cylinder body and the thickness of the side portion of the cylinder head in order to provide the blowby passage separately from the oil recovery passage. Typical cylinder bodies and cylinder heads are formed by casting. Thick-walled parts of the castings cause an increase in weight.

In order to overcome the previously unrecognized and unsolved challenges described above, a preferred embodiment of the present invention provides an outboard motor including an engine including a crankshaft that is rotatable about a rotation axis extending in an up-down direction, and a crank chamber that houses the crankshaft, an oil pan that is disposed under the engine and is configured to retain lubricating oil to be supplied to at least the crank chamber, an oil recovery passage that extends downward from the crank chamber to the oil pan and is configured to lead lubricating oil inside the crank chamber to an inside of the oil pan, and a first blowby gas passage that is separated from the oil recovery passage and extends downward from the crank chamber to the oil pan and is configured to lead a blowby gas inside the crank chamber to an inside of the oil pan.

According to this arrangement, because it is unnecessary to provide a first blowby gas passage laterally relative to the cylinders in the cylinder body, the thickness of a side portion of the cylinder body is significantly reduced at a portion that is lateral relative to the cylinders. A reduction in weight is thus achieved. Also, because lubricating oil and a blowby gas flow into the oil pan through the separate passages, the flow of lubricating oil that is recovered from the crank chamber into the oil pan through the oil recovery passage is prevented from being disrupted by a blowby gas. Thus, problems caused by the disruption of a blowby gas with the flow of lubricating oil are significantly reduced or prevented. Specifically, a rise in the temperature of lubricating oil due to agitation of the lubricating oil and a drop in engine output caused by the flow-through resistance of lubricating oil are significantly reduced or prevented.

The first blowby gas passage preferably extends in the up-down direction along the crank chamber. According to this arrangement, a blowby gas is smoothly led to the inside of the oil pan.

The first blowby gas passage preferably includes a gas inflow port opening at an inner wall surface of the crank chamber, and an in-engine gas passage extending in the up-down direction along the crank chamber inside the engine from the gas inflow port up to a bottom portion of the inner wall surface of the crank chamber.

According to this arrangement, a blowby gas that has flowed in from the gas inflow port is smoothly led to the inside of the oil pan via the in-engine gas passage.

The oil recovery passage preferably includes an oil inflow port opening at a bottom portion of an inner wall surface of the crank chamber, and the first blowby gas passage preferably includes a gas inflow port opening at the inner wall surface of the crank chamber, disposed higher than the oil inflow port.

According to this arrangement, lubricating oil inside the crank chamber is smoothly led to the oil recovery passage via the oil inflow port opening at the bottom portion of the inner wall surface of the crank chamber. In the crank chamber, a blowby gas is smoothly led, via the gas inflow ports disposed higher than the oil inflow port, to the first blowby gas passage in a state of being separated from lubricating oil.

The engine preferably includes a guide plate projecting from the inner wall surface of the crank chamber, extending in the up-down direction inside the crank chamber, and the oil recovery passage preferably includes an oil guide groove defined by the guide plate and crank chamber, extending in the up-down direction inside the crank chamber, and disposed higher than the oil inflow port.

According to this arrangement, lubricating oil is guided to the oil inflow port via the oil guide groove. The oil guide groove is preferably provided with a simple structure using the guide plate projecting from the inner wall surface of the crank chamber.

The engine preferably includes a plurality of cylinders arrayed in the up-down direction, and the first blowby gas passage preferably includes a plurality of gas inflow ports respectively disposed at heights within respective height ranges of at least two of the plurality of cylinders, opening at an inner wall surface of the crank chamber.

If the gas inflow port is solely provided, because of the motion of the piston near the single gas inflow port, the flow direction of a blowby gas changes. Therefore, with the single gas inflow port, the gas becomes less easy to flow therein. In contrast thereto, according to a preferred embodiment of the present arrangement, because a plurality of gas inflow ports respectively corresponding to at least two cylinders are preferably provided, a blowby gas that changes in flow direction is made to flow in any of the gas inflow ports with efficiency.

The engine preferably includes a plurality of crank support portions arrayed in the up-down direction at an interval, to rotatably support the crankshaft, and the gas inflow port may be disposed higher than a center line of the cylinder between two of the crank support portions adjacent in the up-down direction.

According to this arrangement, lubricating oil that tends to flow downward due to gravity less easily flows into a corresponding gas inflow port disposed higher than the center line of the corresponding cylinder inside the crank chamber. An inflow of lubricating oil to the gas inflow port is thus significantly reduced or prevented.

The engine preferably includes a cylinder body that defines a cylinder, and a crank case that defines the crank chamber together with the cylinder body, and the oil recovery passage and first blowby gas passage preferably are defined in the cylinder body.

According to this arrangement, because the oil recovery passage and the first blowby gas passage are both defined in the cylinder body, the structure is greatly simplified.

The oil recovery passage and first blowby gas passage preferably are disposed on mutually opposite sides with respect to a plane including the rotation axis of the crankshaft and a center line of a cylinder.

According to this arrangement, the oil recovery passage and the first blowby gas passage preferably are disposed on mutually opposite sides with respect to the plane. Lubricating oil and a blowby gas are thus easily separated from each other.

The first blowby gas passage preferably includes an in-engine gas passage provided inside the engine, and a gas inflow port extending to a downstream side in a rotation direction of the crankshaft from the in-engine gas passage up to an inner wall surface of the crank chamber. According to this arrangement, lubricating oil inside the crank chamber tends to be agitated toward the downstream side in the rotation direction of the crankshaft by the rotating crankshaft. Because the gas inflow port opens the in-engine gas passage toward the downstream side in the rotation direction of the crankshaft, inflow of the agitated lubricating oil to the gas inflow port is significantly reduced or prevented.

The engine preferably includes a rib that is disposed on the periphery of the in-engine gas passage inside the crank chamber, and that prevents an inflow of lubricating oil to the gas inflow port.

According to this arrangement, the rib prevents an inflow of lubricating oil to the gas inflow port.

The engine preferably further includes a cam chamber that houses a cam shaft, and the outboard motor preferably further includes a second blowby gas passage configured to lead a blowby gas from the oil pan to the cam chamber.

According to this arrangement, a blowby gas led to the oil pan via the first blowby gas passage preferably is led to the cam chamber via the second blowby gas passage.

The engine preferably includes a cylinder body that defines a cylinder, and the second blowby gas passage may extend from the oil pan to the cam chamber by way of the cylinder body.

According to this arrangement, because the second blowby gas passage does not need to be arranged lateral to the cylinder in the cylinder body, the thickness of a side portion of the cylinder body is greatly reduced at the portion lateral to the cylinder. A reduction in weight is thus achieved.

The outboard motor preferably further includes an exhaust passage extending downward from the engine through the oil pan, and an exhaust guide provided with a portion of the oil recovery passage, the first blowby gas passage, and the exhaust passage, disposed between the engine and the oil pan.

According to this arrangement, when an exhaust guide provided with a portion of the exhaust passage is provided between the engine and oil pan, the oil recovery channel and the first blowby gas passage are provided in the exhaust guide.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
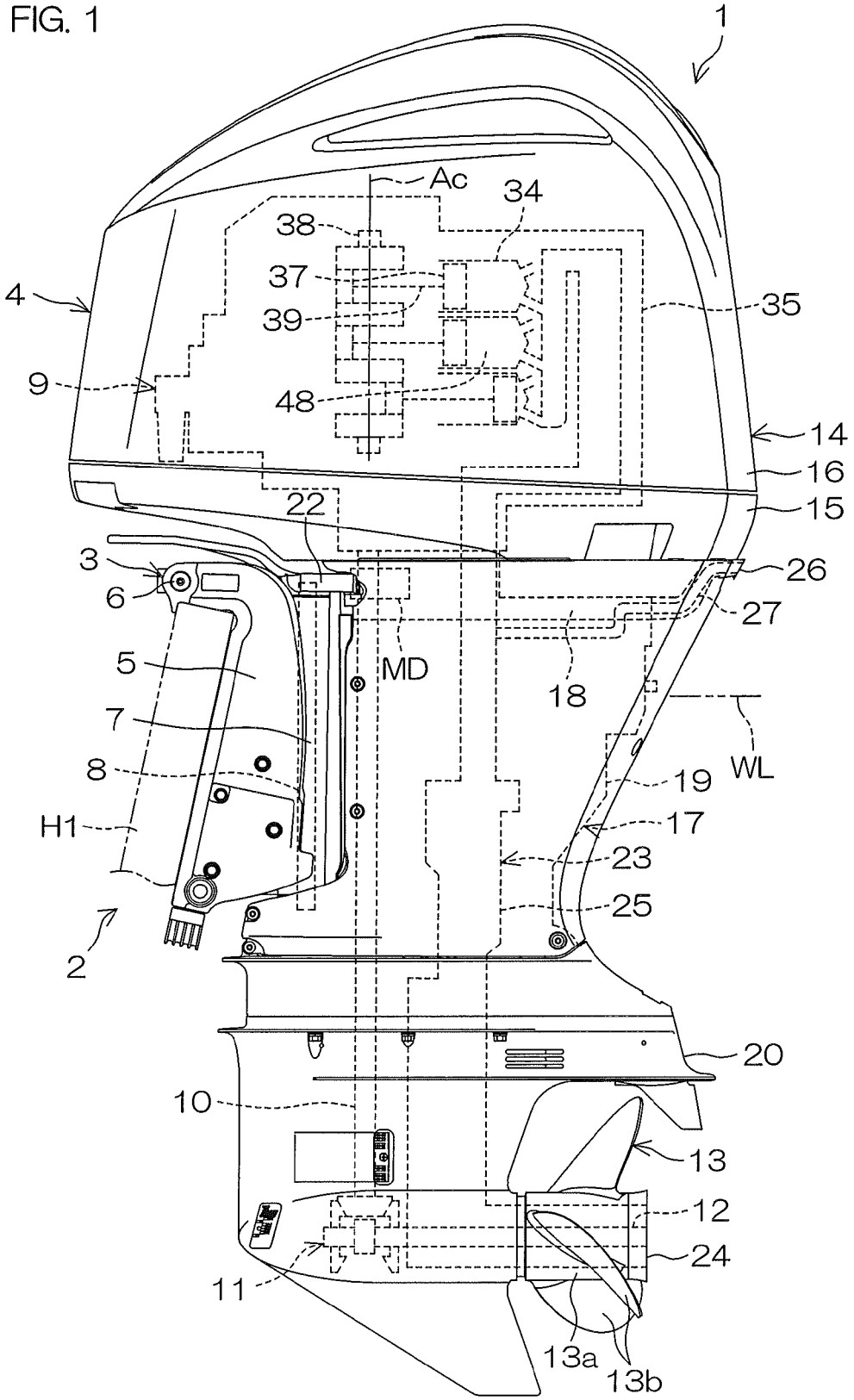
FIG. 1 is a schematic side view of an outboard motor according to a preferred embodiment of the present invention.

FIG. 1 is a schematic side view showing a vessel 1 according to a preferred embodiment of the present invention. As shown in FIG. 1, the vessel 1 includes a hull H1 that is configured to float on a water surface and a vessel propulsion device 2 that is configured to propel the hull H1. The vessel propulsion device 2 includes a suspension device 3 that is mountable on a rear portion (stern) of the hull H1 and an outboard motor 4 coupled to the suspension device 3.

The suspension device 3 includes a pair of left and right clamp brackets 5 to be mounted on the hull H1, a tilting shaft 6 supported in a posture of extending in the left-right direction by the pair of clamp brackets 5, and a swivel bracket 7 mounted on the tilting shaft 6. The suspension device 3 further includes a steering shaft 8 supported in a posture of extending in the up-down direction by the swivel bracket 7.

The outboard motor 4 is mounted on the steering shaft 8. The steering shaft 8 is supported by the swivel bracket 7 so as to be rotatable about a steering axis (center line of the steering shaft 8) extending in the up-down direction. The swivel bracket 7 is supported by the clamp brackets 5 via the tilting shaft 6. The swivel bracket 7 is turnable about a tilt axis (center line of the tilting shaft 6) extending in the left-right direction, with respect to the clamp brackets 5. The outboard motor 4 is turnable to the left and right with respect to the suspension device 3, and is turnable up and down with respect to the suspension device 3. Thus, the outboard motor 4 is turnable to the left and right with respect to the hull H1, and is turnable up and down with respect to the hull H1.

Also, the vessel 1 preferably includes a steering bracket 22 to be mounted on the steering shaft 8 in an integrally rotatable manner, and a mount damper MD configured to function as a mount that couples the steering bracket 22 and an exhaust guide 18 to be described later of the outboard motor 4. The mount damper MD is interposed between the hull H1 and the outboard motor 4, and is configured to significantly reduce or prevent vibration of the outboard motor 4 from being transmitted to the hull H1.

The outboard motor 4 includes an engine 9 that generates power to rotate a propeller 13 and propel the hull 1 and a power transmission system that transmits the power of the engine 9 to the propeller 13. The power transmission system includes a drive shaft 10 coupled to the engine 9, a forward/reverse switching mechanism 11 coupled to the drive shaft 10, and a propeller shaft 12 coupled to the forward/reverse switching mechanism 11. The outboard motor 4 further includes an engine cover 14 that covers the engine 9 and a casing 17 that houses the power transmission system.

The engine cover 14 houses the engine 9. The engine cover 14 includes a cup-shaped bottom cover 15 opened upward, and a cup-shaped top cover 16 opened downward. The top cover 16 is removably mounted on the bottom cover 15. The opening portion of the top cover 16 is laid on the opening portion of the bottom cover 15 via a seal (not shown) one on the top of the other. The bottom cover 15 is mounted on the casing 17.

The casing 17 includes an exhaust guide 18 disposed under the engine 9, an upper case 19 disposed under the exhaust guide 18, and a lower case 20 disposed under the upper case 19. The engine 9 is mounted on the exhaust guide 18. The engine 9 is disposed higher than the steering shaft 8. The exhaust guide 18 defining and serving as an engine support member supports the engine 9 with a rotation axis of the engine 9 (corresponding to a rotation axis Ac of a crankshaft 38) being in a vertical posture.

The engine 9 is disposed over the drive shaft 10. The drive shaft 10 extends in the up-down direction inside the casing 17. A center line of the drive shaft 10 preferably is disposed on the rotation axis of the engine 9, and preferably is deviated with the rotation axis of the engine 9. An upper end portion of the drive shaft 10 is coupled to the engine 9. A lower end portion of the drive shaft 10 is coupled to a front end portion of the propeller shaft 12 via the forward/reverse switching mechanism 11. The propeller shaft 12 extends in the front-rear direction inside the casing 17. A rear end portion of the propeller shaft 12 projects rearward from the casing 17. The propeller 13 is removably mounted on the rear end portion of the propeller shaft 12. The propeller 13 includes an outer cylinder 13*a* surrounding the propeller shaft 12 about a propeller axis (center line of the propeller shaft 12), and a plurality of blades 13*b* extending outward from the outer cylinder 13*a*. The outer cylinder 13*a* and the blades 13*b* rotate about the propeller axis together with the propeller shaft 12.

The engine 9 preferably is an internal combustion engine. The engine 9 rotates in a fixed rotation direction. The rotation of the engine 9 is transmitted to the propeller 13 by the power transmission system (the drive shaft 10, the forward/reverse switching mechanism 11, and the propeller shaft 12). The propeller 13 is thus caused to rotate together with the propeller shaft 12 and a thrust that propels the vessel 1 forward or in reverse is generated. Also, the direction of a rotation transmitted from the drive shaft 10 to the propeller shaft 12 is switched by the forward/reverse switching mechanism 11. The rotation direction of the propeller 13 and the propeller shaft 12 is thus switched between a normal rotation direction (clockwise direction when the propeller 13 is viewed from the rear) and a reverse rotation direction (direction of rotation opposite to the normal rotation direction). The direction of thrust is thus switched.

The outboard motor 4 includes an exhaust passage 23 that discharges exhaust generated by the engine 9 to the outside of the outboard motor 4. The exhaust passage 23 is provided in the interior of the outboard motor 4. The exhaust passage 23 includes an exhaust port 24 opening at a rear end portion of the propeller 13 (a rear end portion of the outer cylinder 13*a*), and a main exhaust passage 25 extending from a combustion chamber 48 of the engine 9 to the exhaust port 24. The exhaust passage 23 further includes an idle exhaust port 26 opening at an outer surface of the outboard motor 4, and an idle exhaust passage 27 extending from the main exhaust passage 25 to the idle exhaust port 26.

The main exhaust passage 25 extends downward from the engine 9 up to the propeller shaft 12 via the exhaust guide 18, and extends rearward along the propeller shaft 12. The main exhaust passage 25 opens rearward at the rear end portion of the propeller 13. The exhaust port 24 is thus disposed in water. The idle exhaust port 26 and the idle exhaust passage 27 are disposed higher than the exhaust port 24. The idle exhaust passage 27 branches from the main exhaust passage 25. The idle exhaust port 26 is disposed higher than a waterline WL (height of the water surface when the vessel 1 equipped with the vessel propulsion device 2 is stopped). The idle exhaust port 26 thus opens into air.

The exhaust generated in the combustion chamber 48 is discharged into the main exhaust passage 25, and is guided toward the exhaust port 24. When the output of the engine 9 is high, the exhaust inside the main exhaust passage 25 is mainly discharged into water from the exhaust port 24. Also, a portion of the exhaust inside the main exhaust passage 25 is led to the idle exhaust port 26 by the idle exhaust passage 27, and is released into the atmosphere from the idle exhaust port 26. On the other hand, when the output of the engine 9 is low (for example, when the engine 9 is idling), the exhaust pressure inside the main exhaust passage 25 is low and the exhaust inside the main exhaust passage 25 is thus mainly released into the atmosphere from the idle exhaust port 26.

The engine 9 includes an engine main body 35 provided with a plurality of cylinders 34. The engine 9 may be an in-line engine or a V-type engine, or may be an engine of a type other than these, for example. Also, the engine 9 is not limited to being a multi-cylinder engine and may instead be a single-cylinder engine, for example. The engine main body 35 includes a plurality of pistons 37 respectively disposed inside the plurality of cylinders 34, a crankshaft 38 that is rotatable about the rotation axis Ac extending in the up-down direction, and a plurality of connecting rods 39 that couple each of the plurality of pistons 37 to the crankshaft 38.

Figure 2:
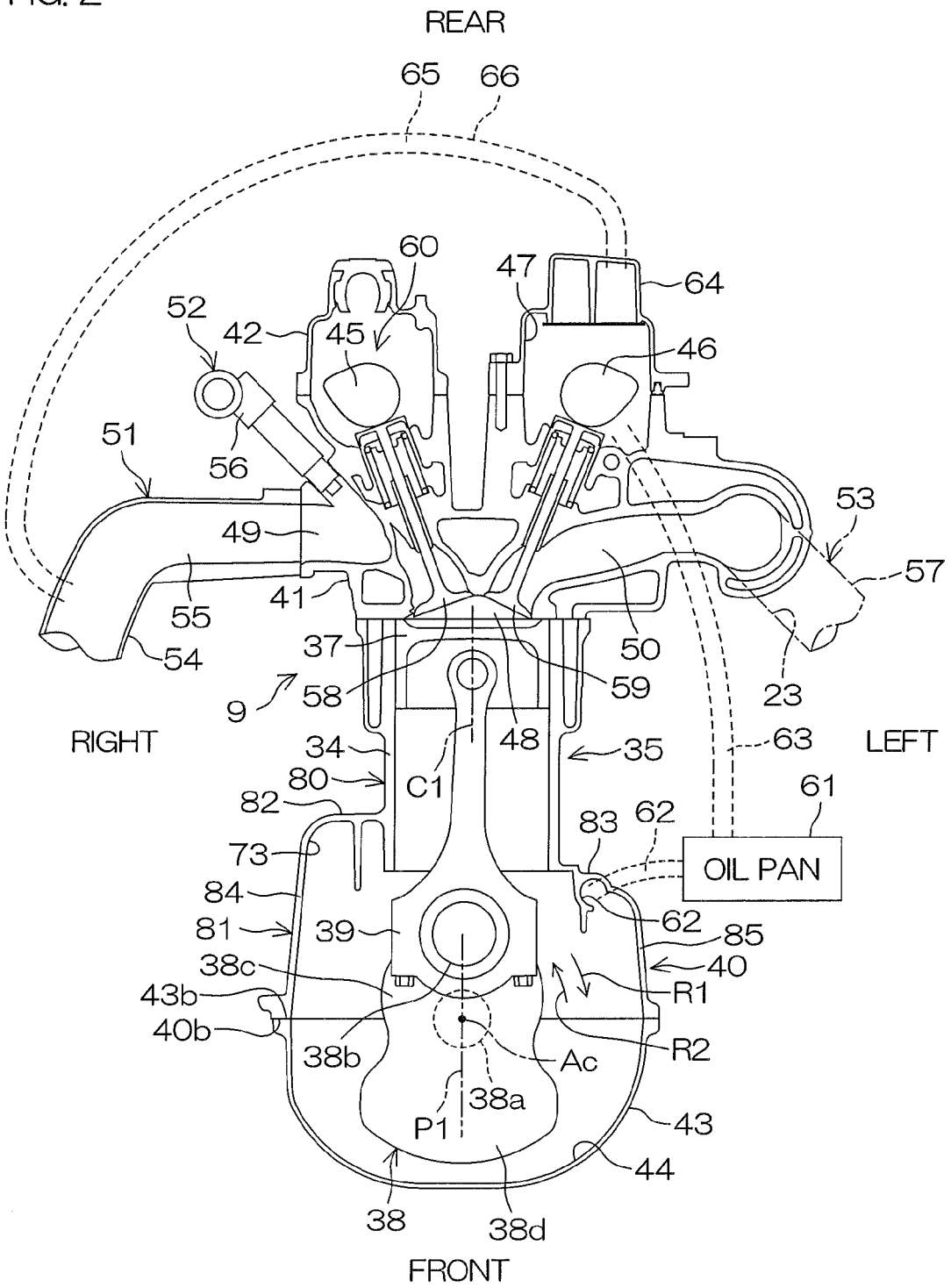
FIG. 2 is a schematic sectional view of an engine.

FIG. 2 is a schematic view showing a schematic configuration of the engine 9 in FIG. 1. As shown in FIG. 2, the engine main body 35 further includes a cylinder body 40 that houses the plurality of pistons 27, a cylinder head 41 that defines the plurality of cylinders 34 together with the cylinder body 40, a head cover 42 that covers the cylinder head 41, and a crank case 43 that houses the crankshaft 38 together with the cylinder body 40.

The crank case 43, the cylinder body 40, the cylinder head 41, and the head cover 42 are aligned in the front-rear direction in this order from the front. The cylinder head 41 and the crack case 43 are mounted on the cylinder body 40, and are disposed on mutually opposite sides with respect to the cylinder body 40. The head cover 42 is mounted on the cylinder head 41. The crank case 43 and the cylinder body 40 define a crank chamber 44 to house the crankshaft 38 between the crank case 43 and the cylinder body 40. The cylinder head 41 and the head cover 42 define a cam chamber 47 to house an intake cam shaft 45 and an exhaust cam shaft 46 between the cylinder head 41 and the head cover 42.

The engine main body 35 includes pluralities of combustion chambers 48, intake ports 49, and exhaust ports 50 provided in the cylinder head 41. Each intake port 49 and each exhaust port 50 open at an outer surface of the cylinder head 41, and extend from the outer surface of the cylinder head 41 up to the inner surface of a corresponding combustion chamber 48.

The engine 9 includes an intake device 51 that supplies air to the plurality of combustion chambers 48, a fuel supply device 52 that supplies fuel to the plurality of combustion chambers 48, and an exhaust device 53 that discharges exhaust generated in the plurality of combustion chambers 48 via the plurality of exhaust ports 50. The intake device 51, the fuel supply device 52, and the exhaust device 53 are mounted on the engine main body 35.

The intake device 51 includes an intake pipe 54 that supplies air to the plurality of combustion chambers 48 via the plurality of intake ports 49. The intake pipe 54 is mounted to the cylinder head 41, and the interior of the intake pipe 54 is connected to each intake port 49. The intake ports 49 and the intake pipe 54 define a portion of an intake passage 55 that guides air to the combustion chambers 48.

The fuel supply device 52 includes a plurality of fuel injectors 56 that supply fuel to the plurality of combustion chambers 48. An outlet of the fuel injector 56 that injects fuel is disposed in the intake port 49.

The exhaust device 53 includes an exhaust pipe 57 that guides exhaust discharged from the plurality of combustion chambers 48 via the plurality of exhaust ports 50. The exhaust pipe 57 is mounted to the cylinder head 41. The cylinder body 40, the cylinder head 41, and the exhaust pipe 57 define a portion of the exhaust passage 23.

The engine 9 includes a plurality of intake valves 58 that open and close the plurality of intake ports 49, a plurality of exhaust valves 59 that open and close the plurality of exhaust ports 50, and a valve device 60 that moves the plurality of intake valves 58 and the plurality of exhaust valves 59 to open and close corresponding intake ports 49 and corresponding exhaust ports 50. The valve device 60 includes the intake cam shaft 45, the exhaust cam shaft 46, and a cam drive device (not shown) that transmits a rotation of the crankshaft 38 to the intake cam shaft 45 and the exhaust cam shaft 46.

The crankshaft 38 includes a crank journal 38*a*, a crank pin 38*b* that supports the connecting rod 39, a crank arm. 38*c* that couples the crank journal 38*a* and the crank pin 38*b*, and a counterweight 38*d* integrally provided on the crank arm 38*c*. The rotation axis Ac of the crankshaft 38 corresponds to a rotation axis of the crank journal 38*a*.

The outboard motor 4 includes an oil pan 61 that retains lubricating oil to be supplied to the engine 9. In FIG. 2, the oil pan 61 is schematically shown. In actuality, the oil pan 61 is disposed under the engine 9. More specifically, the oil pan 61 is disposed under the cylinder body 40 and the crank case 43 (deep side of the sheet in FIG. 2). The outboard motor 4 includes a first blowby gas passage 62 that is configured to lead a blowby gas having flowed in the interior of the crank chamber 44 (a gas that has leaked out of the combustion chamber 48 through a gap between the cylinder 34 and the piston 37) to the oil pan 61, and a second blowby gas passage 63 that is configured to lead a blowby gas from the oil pan 61 to the cam chamber 47.

The outboard motor 4 further includes a gas-liquid separator (oil separator) 64 that separates a liquid component from a blowby gas flowed in the cam chamber 47, and a third blowby gas passage 65 configured to lead a blowby gas from the gas-liquid separator 64 to the intake device 51. The gas-liquid separator 64 is defined by a portion of the head cover 42. The interior of the gas-liquid separator 64 is connected to the interior of the cam chamber 47 and configured such that a fluid is capable of moving in and out of the interior of the gas-liquid separator 64 and the interior of the cam chamber 47. The third blowby gas passage 65 extends from the head cover 42 to the intake pipe 54. A portion of the third blowby gas passage 65 is defined by a blowby hose 66.

Figure 3:
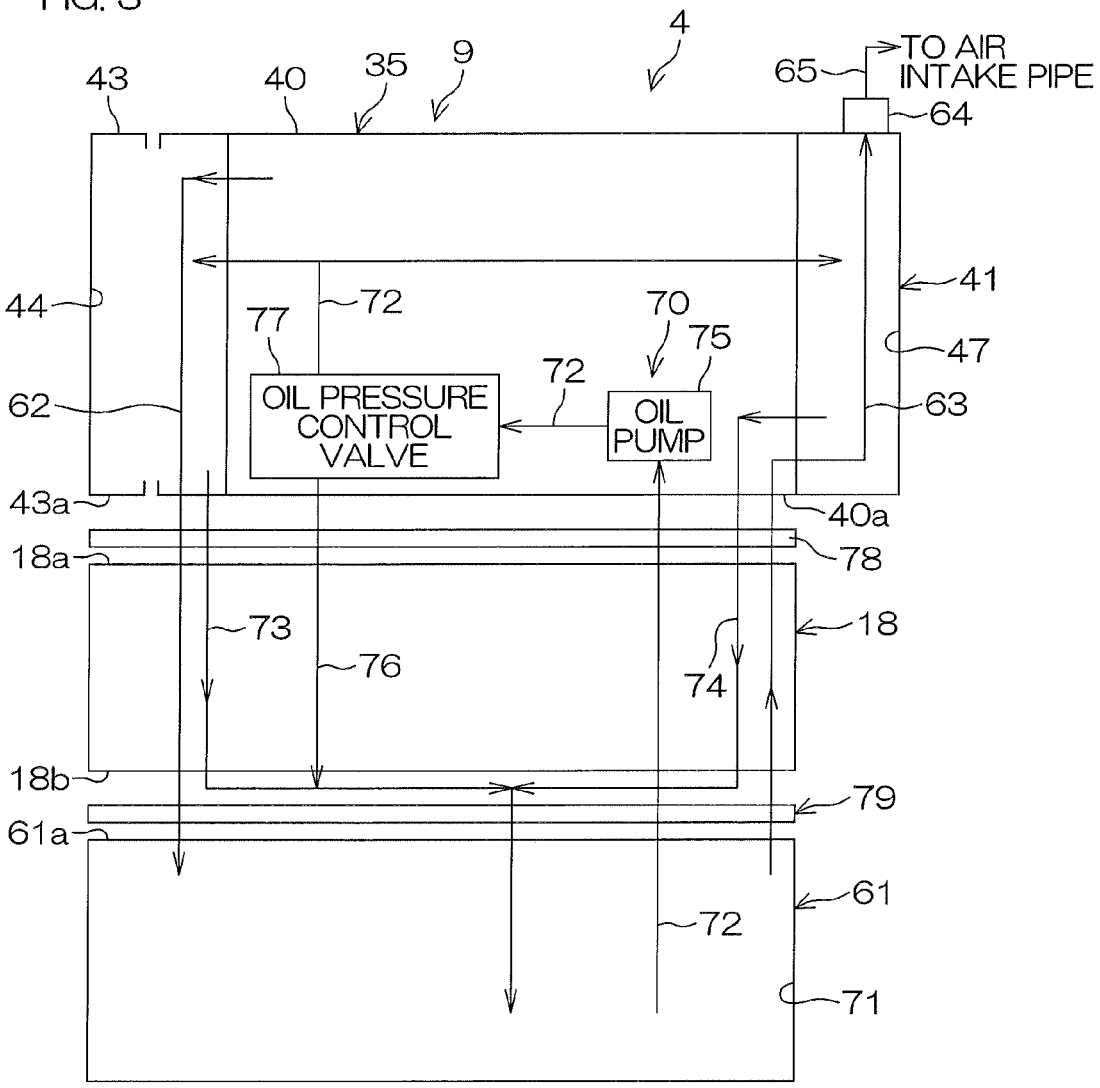
FIG. 3 is a block diagram schematically showing flows of lubricating oil and blowby gas.

FIG. 3 is a block diagram schematically showing an example of flows of lubricating oil and a blowby gas. As shown in FIG. 3, the first blowby gas passage 62 extends downward from the crank chamber 44 to an oil retaining portion 71. That is, the first blowby gas passage 62 extends from the cylinder body 40 to the oil pan 61 by way of the exhaust guide 18. The second blowby gas passage 63 extends from the oil pan 61 to the cylinder head 41 by way of the exhaust guide 18 and the cylinder body 40.

The outboard motor 4 includes a lubricating device 70. The lubricating device 70 includes the oil pan 61 including an oil retaining portion 71 that retains lubricating oil to be supplied to at least the crank chamber 44, and disposed under the engine 9. The lubricating device 70 further includes an oil supply passage 72 configured to lead lubricating oil in the oil retaining portion 71 to at least the crank chamber 44 of the engine 9. In the present preferred embodiment, description will be given in line with the example in which lubricating oil is, as shown in FIG. 3, led to the crank chamber 44 and the cam chamber 47.

The lubricating device 70 further includes a first oil recovery passage 73 that extends downward from the crank chamber 44 to the oil retaining portion 71 and is configured to lead lubricating oil inside the crank chamber 44 to the oil retaining portion 71 of the oil pan 61. The lubricating device 70 further includes a second oil recovery passage 74 that is configured to return lubricating oil used for lubrication inside the cam chamber 47 to the oil retaining portion 71 of the oil pan 61. The first blowby gas passage 62 is defined separately from the first oil recovery passage 73.

The lubricating device 70 further includes an oil pump 75 disposed halfway along the oil supply passage 72 and to be driven by the engine 9, a third oil recovery passage 76 branching from a branch position disposed downstream of the oil pump 75 in the oil supply passage 72, and an oil pressure control valve 77 disposed at the branch position.

The oil pressure control valve 77 defines and serves as a relief function of returning a portion of the lubricating oil in the oil supply passage 72 to the oil retaining portion 71 of the oil pan 61 via the third oil recovery passage 76 when the pressure of the lubricating oil has reached a set pressure or more. The pressure of the lubricating oil inside the oil supply passage 72 is thus maintained to be less than the set pressure.

The outboard motor 4 includes an engine gasket 78 and an oil pan gasket 79. The engine gasket 78 is disposed between the engine 9 and the oil pan 61. The exhaust guide 18 is disposed between the engine gasket 78 and the oil pan 61. The oil pan gasket 79 is disposed between the exhaust guide 18 and the oil pan 61. Specifically, the engine gasket 78 is disposed between a lower end portion 40*a* of the cylinder body 40 and a lower end portion 43*a* of the crank case 43 and an upper end portion 18*a* of the exhaust guide 18. The oil pan gasket 79 is disposed between a lower end portion 18*b* of the exhaust guide 18 and an upper end portion 61*a* of the oil pan 61. In the respective gaskets 78 and 79, holes (which are not shown in FIG. 3 being a schematic view) through which corresponding oil and blowby gas are passed are respectively defined.

Referring again to FIG. 2, the cylinder body 40 includes a cylinder defining portion 80 that defines the plurality of cylinders 34 together with the cylinder head 41, and a crank chamber defining portion 81 that is coupled to the cylinder defining portion 80, and defines the crank chamber 44 together with the crank case 43. A front end portion 40*b* of the cylinder body 40 and a rear end portion 43*b* of the crank case 43 abut against each other.

Figure 4:
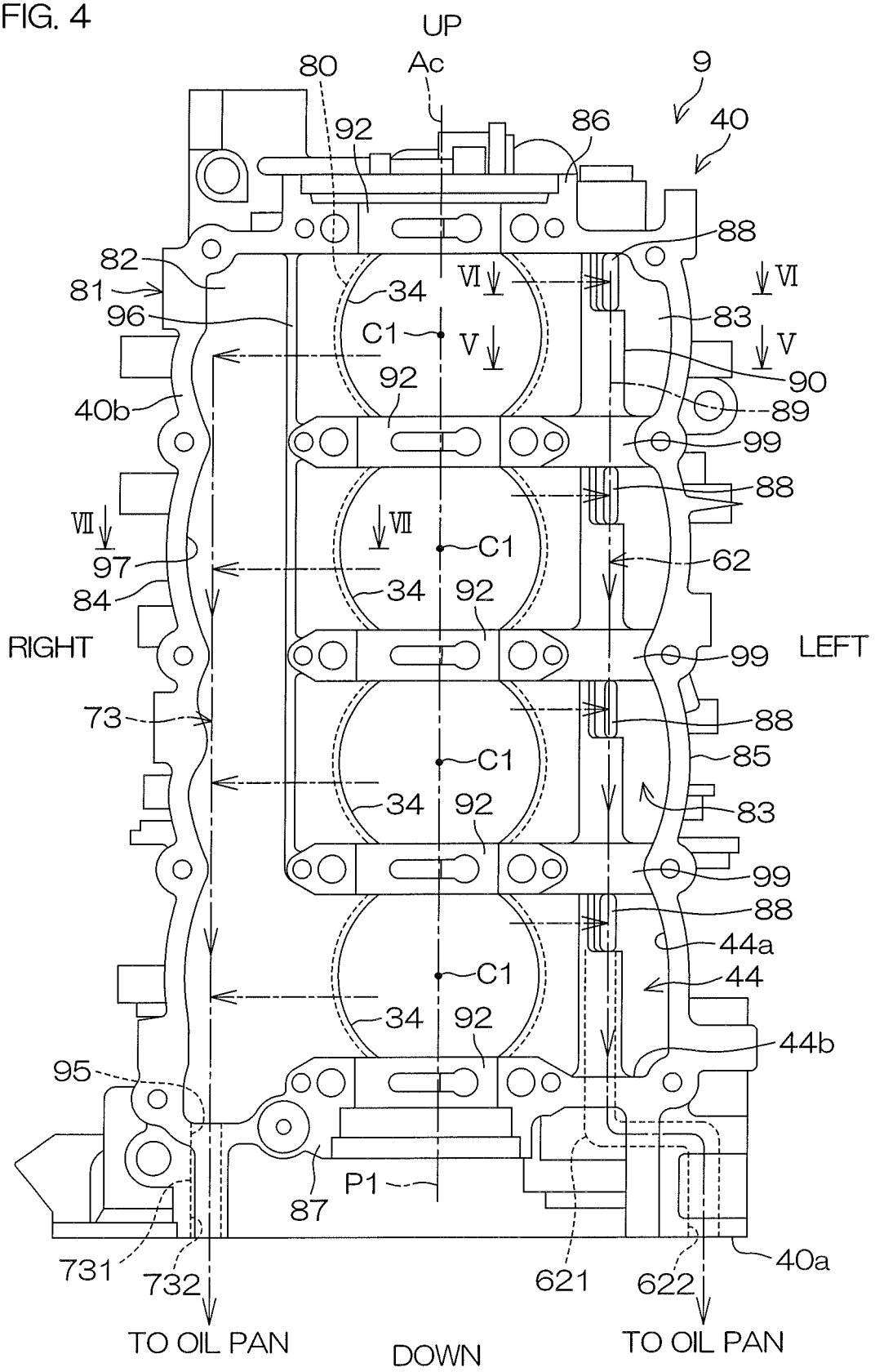
FIG. 4 is a front view of a cylinder body.

FIG. 4 is a front view of the cylinder body 40. As shown in FIG. 2 and FIG. 4, the crank chamber defining portion 81 of the cylinder body 40 includes a first rear wall 82 coupled to one side portion of the cylinder defining portion 80, a second rear wall 83 coupled to the other side portion of the cylinder defining portion 80, a first side wall 84 extending substantially forward from the first rear wall 82, and a second side wall 85 extending substantially forward from the second rear wall 83. As shown in FIG. 4, the crank chamber defining portion 81 of the cylinder body 40 further includes a top wall 86 that couples upper end portions of the first rear wall 82, the second rear wall 83, the first side wall 84, and the second side wall 85. The crank chamber defining portion 81 of the cylinder body 40 further includes a bottom wall 87 that couples lower end portions of the first rear wall 82, the second rear wall 83, the first side wall 84, and the second side wall 85.

The first blowby gas passage 62 extends in the up-down direction along the crank chamber 44. The first blowby gas passage 62 includes a gas inflow port 88 opening at an inner wall surface 44*a* of the crank chamber 44, and an in-engine gas passage 89 extending in the up-down direction along the crank chamber 44 inside the engine 9 from the gas inflow port 88 up to a bottom portion 44*b* of the inner wall surface 44*a* of the crank chamber 44.

Figure 5:
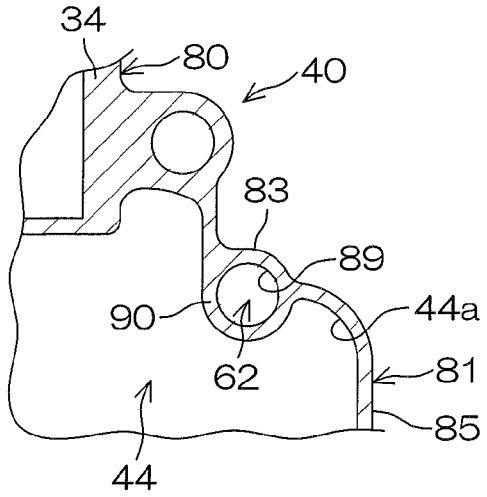
FIG. 5 is a sectional view of the cylinder body cut along line V-V in FIG. 4, in which a section of an in-engine gas passage is shown.

FIG. 5 is a sectional view taken along line V-V in FIG. 4. As shown in FIG. 5, the in-engine gas passage 89 is demarcated by a hollow pipe 90 extending continuously from the second rear wall 83 of the cylinder body 40. As shown in FIG. 4, the hollow pipe 90 is arranged in the cylinder body 40 to extend in the up-down direction along the crank chamber 44 inside the engine 9 up to the bottom portion 44*b* (corresponding to an upper surface of the bottom wall 87) of the inner wall surface 44*a* of the crank chamber 44. The first blowby gas passage 62 is thus defined in the cylinder body 40.

The first blowby gas passage 62 includes a passage 621 that penetrates through the bottom wall 87 of the crank chamber defining portion 81 of the cylinder body 40. The passage 621 defines an opening 622 of the first blowby gas passage 62 in the lower end portion 40*a* of the cylinder body 40. The first blowby gas passage 62 extends to the oil pan 61 via the opening 622. Specifically, the first blowby gas passage 62 communicates with the inside of the oil retaining portion 71 of the oil pan 61 via the opening 622, an opening of the engine gasket 78, a gas passage inside the exhaust guide 18, and an opening of the oil pan gasket 79.

Figure 6:
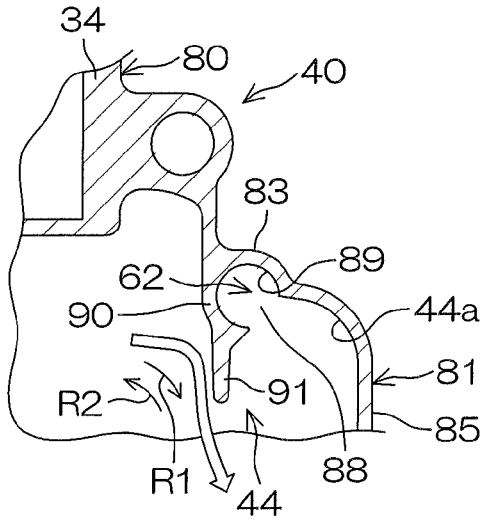
FIG. 6 is a sectional view of the cylinder body cut along line VI-VI in FIG. 4, in which a section of a portion provided with a gas inflow port which is another section of the in-engine gas passage is shown.

FIG. 6 is a sectional view taken along line VI-VI in FIG. 4. As shown in FIG. 6, the gas inflow port 88 extends to a downstream side R1 in a rotation direction of the crankshaft 38 from the in-engine gas passage 89 up to the inner wall surface 44*a* of the crank chamber 44. That is, the gas inflow port 88 makes the in-engine gas passage 89 open inside the crank chamber 44 toward the downstream side R1 in the rotation direction of the crankshaft 38. The cylinder body 40 further includes a rib 91 that is disposed further on an upstream side R2 in the rotation direction of the crankshaft 38 than the gas inflow port 88, and is configured to prevent an inflow of lubricating oil to the inside of the gas inflow port 88. The rib 91 extends from the hollow pipe 90.

As shown in FIG. 4, the engine 9 includes the plurality of cylinders 34. The first blowby gas passage 62 is provided with a plurality of gas inflow ports 88 respectively disposed at heights within respective height ranges of at least two cylinders 34 out of the plurality of cylinders 34. For example, when the engine 9 includes four cylinders 34, four gas inflow ports 88 respectively disposed at heights within respective height ranges of the four cylinders 34 may be provided. Alternatively, when the engine 9 includes four cylinders 34, two gas inflow ports 88 respectively disposed at heights within respective height ranges of two cylinders 34 may be provided, or three gas inflow ports 88 respectively disposed at heights within respective height ranges of three cylinders 34 may be provided.

As shown in FIG. 4, the engine 9 further includes a plurality of crank support portions 92 that are arrayed in the up-down direction at intervals, and rotatably support the crankshaft 38. The crank support portions 92 are provided in the top wall 86, the bottom wall 87, and a plurality of ribs 99 arrayed in the up-down direction at intervals between the top wall 86 and the bottom wall 87 and extending parallel or substantially parallel to the top wall 86 from the second side wall 85. Each gas inflow port 88 is disposed, between two crank support portions 92 adjacent in the up-down direction across a center line C1 of a corresponding cylinder 34, higher than the center line C1 of the corresponding cylinder 34.

Figure 8:
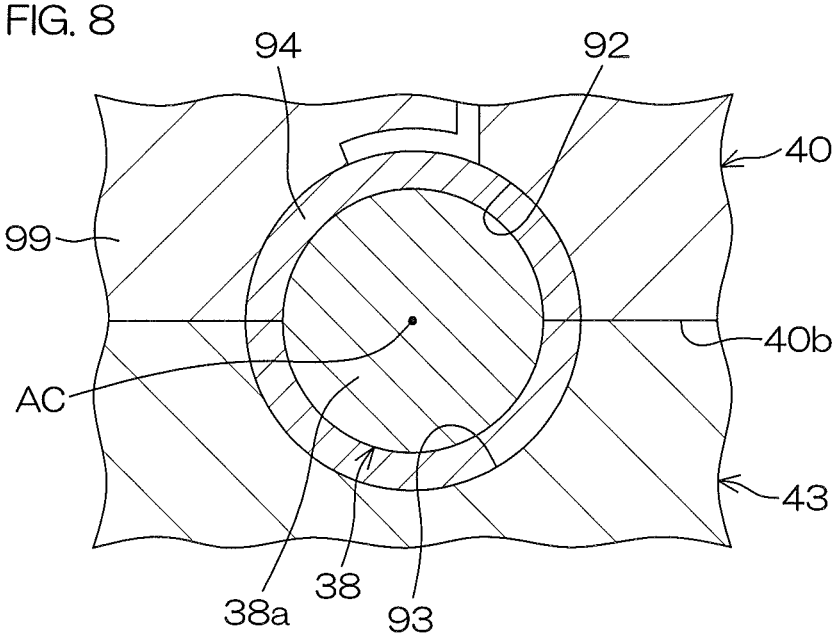
FIG. 8 is a schematic sectional view of a structure that supports a crankshaft.

As shown in FIG. 8, the crank case 43 includes a crank support portion 93 opposed to each crank support portion 92 of the cylinder body 40. The crank journal 38*a* of the crankshaft 38 is, between the crank support portion 92 of the cylinder body 40 and the crank support portion 93 of the crank case 43, rotatably supported via a journal bearing 94.

As shown in FIG. 4, the first oil recovery passage 73 extends in the up-down direction along the crank chamber 44. The first oil recovery passage 73 includes an oil inflow port 95 opening at the bottom portion 44*b* of the inner wall surface 44*a* of the crank chamber 44. The gas inflow ports 88 are thus disposed higher than the oil inflow port 95.

The first oil recovery passage 73 further includes an oil passage 731 that penetrates through the bottom wall 87 of the crank chamber defining portion 81 of the cylinder body 40. The oil passage 731 defines an opening 732 of the first oil recovery passage 73 in the lower end portion 40*a* of the cylinder body 40. The first oil recovery passage 73 extends to the oil pan 61 via the opening 732. Specifically, the first oil recovery passage 73 communicates with the inside of the oil retaining portion 71 of the oil pan 61 via the opening 732, an opening of the engine gasket 78, an oil passage inside the exhaust guide 18, and an oil passage of the oil pan gasket 79.

Figure 7:
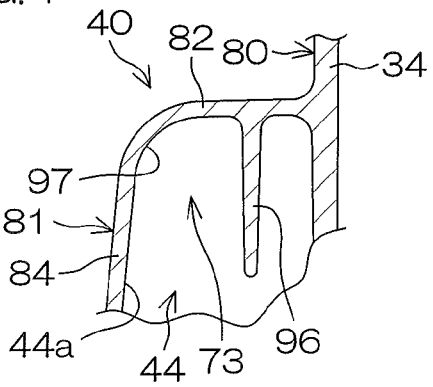
FIG. 7 is a sectional view of the cylinder body cut along line VII-VII in FIG. 4, in which a section of a portion provided with an oil guide groove is shown.

FIG. 7 is a sectional view taken along line VII-VII in FIG. 4. As shown in FIG. 2 and FIG. 7, the engine 9 further includes a guide plate 96 that is projects from the inner wall surface 44*a* of the crank chamber 44, and extends in the up-down direction inside the crank chamber 44. The first oil recovery passage 73 includes an oil guide groove 97 that is defined by the guide plate 96 and the crank chamber 44, and extends in the up-down direction inside the crank chamber 44. As shown in FIG. 4, the oil guide groove 97 is disposed higher than the oil inflow port 95.

As shown in FIG. 7, the guide plate 96 projects forward from the first rear wall 82 of the crank chamber defining portion 81 of the cylinder body 40, and is opposed to the first side wall 84. The oil guide groove 97 is demarcated by the first rear wall 82 and the first side wall 84 of the crank chamber defining portion 81 of the cylinder body 40 and the guide plate 96 opposed to the first side wall 84. The first oil recovery passage 73 and the first blowby passage 62 described above are thus defined in the cylinder body 40.

As shown in FIG. 2 and FIG. 4, the first oil recovery passage 73 and the first blowby gas passage 62 are disposed on mutually opposite sides with respect to a plane P1 including the rotation axis Ac of the crankshaft 38 and the center line C1 of the cylinders 34.

Figure 9:
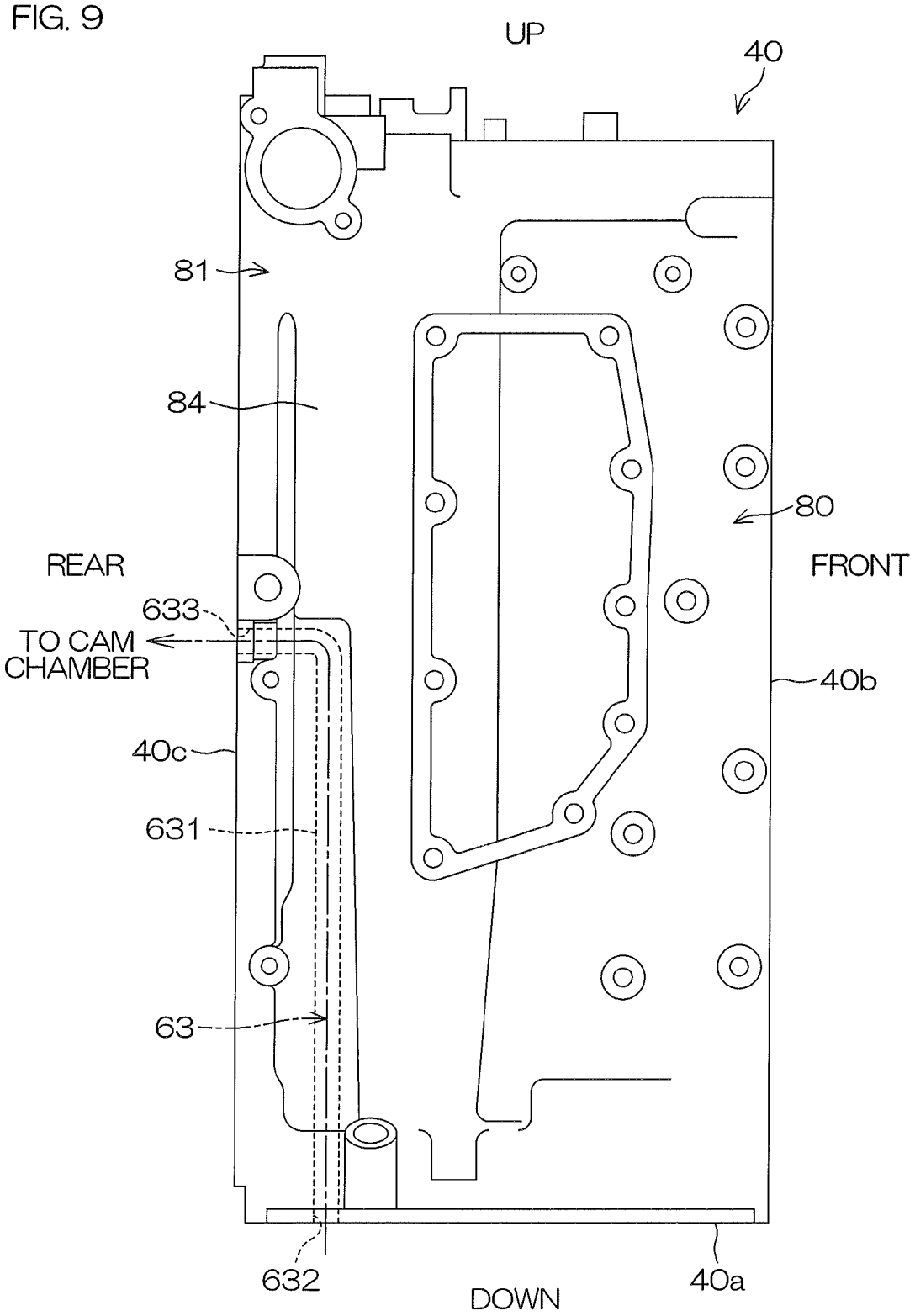
FIG. 9 is a right side view of the cylinder body.

FIG. 9 is a right side view of the cylinder body 40. As shown in FIG. 9, the second blowby gas passage 63 includes a passage 631 that extends substantially in the up-down direction inside the cylinder body 40. The passage 631 defines an opening 632 of the second blowby gas passage 63 in the lower end portion 40*a* of the cylinder body 40. The second blowby gas passage 63 extends to the oil pan 61 via the opening 632. The passage 631 defines an opening 633 of the second blowby gas passage 63 in a rear end portion 40*c* of the cylinder body 40. The second blowby gas passage 63 communicates with the cam chamber 47 via the opening 633.

According to the present preferred embodiment, the following excellent effects are provided. As shown in FIG. 2, the first blowby gas passage 62 extends downward (back side of the sheet in FIG. 2) from the crank chamber 44 to the oil pan 61. Because it is thus unnecessary to provide a first blowby gas passage lateral relative to the cylinders 34 in the cylinder body 40, the thickness of a side portion of the cylinder body 40 is capable of being greatly reduced at the portion lateral relative to the cylinders 34. A reduction in weight is thus achieved.

Also, because lubricating oil and a blowby gas flow into the oil pan 61 through the separate passages (the first oil recovery passage 73 and the first blowby gas passage 62), the flow of lubricating oil that is recovered from the crank chamber 44 into the oil pan 61 through the oil recovery passage (the first oil recovery passage 73) is prevented from being disrupted by a blowby gas. Thus, problems caused by the disruption of a blowby gas with the flow of lubricating oil are significantly reduced or prevented. Specifically, a rise in the temperature of lubricating oil due to agitation of the lubricating oil and a drop in engine output caused by the flow-through resistance of lubricating oil is significantly reduced or prevented.

Because the capacity inside the crank chamber 44 changes due to the motion of the piston 37 inside the cylinder 34, the flow direction of a blowby gas inside the crank chamber 44 is not fixed. If lubricating oil and a blowby gas are led to an oil pan via a common passage, due to the effect of the blowby gas that is not fixed in flow direction, the lubricating oil becomes less easy to flow to the oil pan. In contrast thereto, in the present preferred embodiment, because lubricating oil and a blowby gas are led to the oil pan 61 via the separate passages, the lubricating oil becomes easy to flow to the oil pan 61.

As shown in FIG. 4, the first blowby gas passage 62 extends in the up-down direction along the crank chamber 44. Thus, a blowby gas is smoothly led to the inside of the oil pan 61.

The first blowby gas passage 62 includes a gas inflow port 88 opening at the inner wall surface 44*a* of the crank chamber 44, and an in-engine gas passage 89 extending in the up-down direction along the crank chamber 44 inside the engine 9 from the gas inflow port 88 up to the bottom portion 44*b* of the inner wall surface 44*a* of the crank chamber 44. Thus, a blowby gas that has flowed in from the gas inflow port 88 is smoothly led to the inside of the oil pan 61 via the in-engine gas passage 89.

The first oil recovery passage 73 defining and serving as an oil recovery passage includes an oil inflow port 95 opening at the bottom portion 44*b* of the inner wall surface 44*a* of the crank chamber 44. Thus, lubricating oil inside the crank chamber 44 that moves downward because of the gravity flows easily into the oil inflow port 95.

Due to the effect of gravity, oil tends to move downward as compared with gas. The gas inflow port 88 of the first blowby gas passage 62 opens at the inner wall surface 44*a* of the crank chamber 44, and is disposed higher than the oil inflow port 95. Thus, in the crank chamber 44, via the gas inflow port 88 disposed higher than the oil inflow port 95, a blowby gas is smoothly led to the first blowby gas passage 62 in a state of being separated from lubricating oil.

The guide plate 96 provided for the engine 9 projects from the inner wall surface 44*a* of the crank chamber 44, and extends in the up-down direction inside the crank chamber 44. The first oil recovery passage 73 includes an oil guide groove 97 defined by the guide plate 96 and the crank chamber 44. The oil guide groove 97 extends in the up-down direction inside the crank chamber 44, and is disposed higher than the oil inflow port 95. Thus, lubricating oil is smoothly guided to the oil inflow port 95 via the oil guide groove 97. The oil guide groove 97 is capable of being defined with a simple structure using the guide plate 96 projecting from the inner wall surface 44*a* of the crank chamber 44.

The first blowby gas passage 62 includes a plurality of gas inflow ports 88 respectively disposed at heights within respective height ranges of at least two of the plurality of cylinders 34, and opening at the inner wall surface 44*a* of the crank chamber 44. If the gas inflow port is solely provided, because of the motion of the piston near the single gas inflow port, the flow direction of a blowby gas changes. Therefore, with the single gas inflow port, the gas becomes less easy to flow therein. In contrast thereto, according to the present preferred embodiment, because a plurality of gas inflow ports 88 respectively corresponding to at least two cylinders 34 are provided, a blowby gas that changes in flow direction is made to flow in any of the gas inflow ports 88 with efficiency.

The crank support portions 92 provided for the engine 9 are arrayed in the up-down direction at intervals. The gas inflow port 88 of the first blowby gas passage 62 is disposed higher than the center line C1 of the cylinder 34 between two crank support portions 92 adjacent in the up-down direction. Lubricating oil that tends to flow downward due to gravity less easily flows into a corresponding gas inflow port 88 disposed higher than the center line C1 of a corresponding cylinder 34 inside the crank chamber 44. An inflow of lubricating oil to the gas inflow port 88 is thus significantly reduced or prevented.

The engine 9 includes a cylinder body 40 that defines the cylinder 34, and a crank case 43 that defines the crank chamber 44 together with the cylinder body 40. The oil recovery passage 73 and the first blowby gas passage 62 are both defined in the cylinder body 40. The structure is thus simplified.

As shown in FIG. 2 and FIG. 4, the first oil recovery passage 73 and the first blowby gas passage 62 are disposed on mutually opposite sides with respect to the plane P1 including the rotation axis Ac of the crankshaft 38 and the center line C1 of the cylinder 34. Lubricating oil and a blowby gas are thus easily separated from each other.

Lubricating oil inside the crank chamber 44 tends to be agitated toward the downstream side R1 in the rotation direction of the crankshaft 38 by the rotating crankshaft 38 (refer to the outline arrow in FIG. 6). The first blowby gas passage 62 includes a gas inflow port 88 extending to the downstream side R1 in the rotation direction of the crankshaft 38 from the in-engine gas passage 89 up to the inner wall surface 44*a* of the crank chamber 44. Because the gas inflow port 88 opens the in-engine gas passage 89 toward the downstream side R1 in the rotation direction of the crankshaft 38, inflow of the agitated lubricating oil to the gas inflow port 88 is significantly reduced or prevented.

Further, the rib 91 disposed on the periphery of the in-engine gas passage 89 inside the crank chamber 44 prevents an inflow of lubricating oil to the gas inflow port 88.

There is preferably provided a second blowby gas passage 63 configured to lead a blowby gas from the oil pan 61 to the cam chamber 47. Thus, a blowby gas led to the oil pan 61 via the first blowby gas passage 62 is led to the cam chamber 47 via the second blowby gas passage 63.

The second blowby gas passage 63 extends from the oil pan 61 to the cam chamber 47 by way of the cylinder body 40 of the engine 9. The second blowby gas passage 63 needs not to be provided laterally relative to the cylinder 34 in the cylinder body 40. The thickness of a side portion of the cylinder body 40 is thus reduced. Specifically, it suffices to provide the second blowby gas passage 63 in the crank chamber defining portion 81 of the cylinder body 40, not in the cylinder defining portion 80 of the cylinder body 40. Thus, the thickness of a side portion of the cylinder defining portion 80 defining and serving as a side portion of the cylinder body 40 is significantly reduced.

The exhaust guide 18 provided with a portion of the exhaust passage 23 as shown in FIG. 1 is provided between the engine 9 and the oil pan 61 as shown in FIG. 2. The exhaust guide 18 preferably is provided with the first oil recovery passage 73 and the first blowby gas passage 62.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The present application corresponds to Japanese Patent Application No. 2013-232395 filed in the Japanese Patent Office on Nov. 8, 2013, and the entire disclosure of this application is incorporated herein by reference.

What is claimed is:

1. An outboard motor comprising:

an engine including a crankshaft that is rotatable about a rotation axis extending in an up-down direction, and a crank chamber that houses the crankshaft;

an oil pan that is disposed under the engine and retains lubricating oil to be supplied to at least the crank chamber;

an oil recovery passage that extends downward from the crank chamber to the oil pan and leads lubricating oil inside the crank chamber to an inside of the oil pan; and a first blowby gas passage that is separated from the oil recovery passage and extends downward from the crank chamber to the oil pan and that leads a blowby gas inside the crank chamber to an inside of the oil pan.

2. The outboard motor according to claim 1, wherein the first blowby gas passage extends in the up-down direction along the crank chamber.

3. The outboard motor according to claim 2, wherein the first blowby gas passage includes a gas inflow port opening at an inner wall surface of the crank chamber and an in-engine gas passage extending in the up-down direction along the crank chamber inside the engine from the gas inflow port up to a bottom portion of the inner wall surface of the crank chamber.

4. The outboard motor according to claim 1, wherein the oil recovery passage includes an oil inflow port opening at a bottom portion of an inner wall surface of the crank chamber; and the first blowby gas passage includes a gas inflow port opening located at the inner wall surface of the crank chamber and disposed higher than the oil inflow port.

5. The outboard motor according to claim 4, wherein the engine includes a guide plate projecting from the inner wall surface of the crank chamber and extending in the up-down direction inside the crank chamber; and the oil recovery passage includes an oil guide groove defined by the guide plate and crank chamber, extending in the up-down direction inside the crank chamber, and disposed higher than the oil inflow port.

6. The outboard motor according to claim 1, wherein the engine includes a plurality of cylinders arrayed in the up-down direction; and the first blowby gas passage includes a plurality of gas inflow ports that are respectively disposed at heights within respective height ranges of at least two of the plurality of cylinders and open at an inner wall surface of the crank chamber.

7. The outboard motor according to claim 6, wherein the engine includes a plurality of crank support portions arrayed in the up-down direction at an interval and that rotatably support the crankshaft; and the gas inflow port is disposed higher than a center line of the cylinder between two of the crank support portions adjacent in the up-down direction.

8. The outboard motor according to claim 1, wherein the engine includes a cylinder body that defines a cylinder, and a crank case that defines the crank chamber together with the cylinder body; and the oil recovery passage and first blowby gas passage are defined in the cylinder body.

9. The outboard motor according to claim 1, wherein the oil recovery passage and first blowby gas passage are disposed on mutually opposite sides with respect to a plane including the rotation axis of the crankshaft and a center line of a cylinder.

10. The outboard motor according to claim 1, wherein the first blowby gas passage includes an in-engine gas passage provided inside the engine, and a gas inflow port extending to a downstream side in a rotation direction of the crankshaft from the in-engine gas passage up to an inner wall surface of the crank chamber.

11. The outboard motor according to claim 10, wherein the engine includes a rib that is disposed on a periphery of the in-engine gas passage inside the crank chamber and that prevents an inflow of lubricating oil to the gas inflow port.

12. The outboard motor according to claim 1, wherein the engine further includes a cam chamber that houses a cam shaft; and the outboard motor further includes a second blowby gas passage that leads a blowby gas from the oil pan to the cam chamber.

13. The outboard motor according to claim 12, wherein the engine includes a cylinder body that defines a cylinder; and the second blowby gas passage extends from the oil pan to the cam chamber by way of the cylinder body.

14. The outboard motor according to claim 1, further comprising:

an exhaust passage extending downward from the engine through the oil pan; and an exhaust guide including a portion of the oil recovery passage, the first blowby gas passage, and the exhaust passage, disposed between the engine and the oil pan.

* * * * *